US007610869B2

(12) United States Patent
Thomas

(10) Patent No.: US 7,610,869 B2
(45) Date of Patent: Nov. 3, 2009

(54) METHOD AND INSTALLATION FOR LOADING AND UNLOADING COMPRESSED NATURAL GAS

(75) Inventor: Pierre-Armand Thomas, Puteaux (FR)

(73) Assignee: Technip France (FR)

( * ) Notice: Subject to any disclaimer, the term of this patent is extended or adjusted under 35 U.S.C. 154(b) by 0 days.

(21) Appl. No.: 11/574,536

(22) PCT Filed: Aug. 22, 2005

(86) PCT No.: PCT/FR2005/002120

§ 371 (c)(1),
(2), (4) Date: Apr. 26, 2007

(87) PCT Pub. No.: WO2006/027455

PCT Pub. Date: Mar. 16, 2006

(65) Prior Publication Data

US 2007/0253797 A1 Nov. 1, 2007

(30) Foreign Application Priority Data

Sep. 1, 2004 (FR) ..... 04 09268

(51) Int. Cl.
*B63B 25/08* (2006.01)

(52) U.S. Cl. ..... 114/74 R; 114/121; 414/137.1

(58) Field of Classification Search ..... 114/72, 114/74 R, 121, 257, 267; 405/203, 204, 405/219; 414/137.1
See application file for complete search history.

(56) References Cited

U.S. PATENT DOCUMENTS

| | | | | |
|---|---|---|---|---|
| 4,846,088 | A * | 7/1989 | Fanse et al. | 114/72 |
| 5,219,451 | A * | 6/1993 | Datta et al. | 405/204 |
| 5,522,680 | A * | 6/1996 | Hoss et al. | 405/204 |
| 5,839,383 | A * | 11/1998 | Stenning et al. | 114/72 |
| 6,003,460 | A * | 12/1999 | Stenning et al. | 114/72 |
| 6,260,501 | B1 * | 7/2001 | Agnew | 114/257 |
| 6,981,823 | B2 * | 1/2006 | Roraas et al. | 405/204 |
| 2004/0045490 | A1 | 3/2004 | Goldbach | 114/257 |

FOREIGN PATENT DOCUMENTS

| | | |
|---|---|---|
| EP | 1 400 442 | 3/2004 |
| EP | 1 428 748 | 6/2004 |
| WO | WO 03/013951 | 2/2003 |

* cited by examiner

*Primary Examiner*—Lars A Olson
(74) *Attorney, Agent, or Firm*—Ostrolenk Faber LLP

(57) ABSTRACT

A method and an installation for loading and unloading compressed natural gas on ships, said ships being suitable for sea navigation and the ships having receivers. The compressed natural gas is storable in tubes, installed on the receivers. The installation comprises fixed containers for housing tubes, supports for holding a container supported above the sea surface at a given height, devices operable for lowering the receivers, such as to carry each receiver below a fixed container and to lift the receivers so as to lift the fixed container above the given height to support the containers on the receivers.

5 Claims, 2 Drawing Sheets

METHOD AND INSTALLATION FOR LOADING AND UNLOADING COMPRESSED NATURAL GAS

CROSS REFERENCE TO RELATED APPLICATION

The present application is a 35 U.S.C. 00 371 national phase conversion of PCT/FR2005/002120, filed 22 Aug. 2005, which claims priority of French Application No. 0409268, filed 1 Sep. 2004. The PCT International Application was published in the French language.

BACKGROUND OF THE INVENTION

The present invention relates to a method and installation for loading and unloading compressed natural gas onto and off ships.

Unlike shipping natural gas in a liquid form which requires major technical facilities, including for lowering its temperature to the temperature of liquefaction of −163° C., shipping natural gas in a compressed form is, for short distances, much more economical. In this process the natural gas is stored in tubes in which it is compressed to between 200 and 300 bar and the ships have receiving means to which said tubes are fixed.

The ships are thus suitable for shipping compressed natural gas from a loading zone somewhere near an off-shore field, for example, to an unloading zone, such as a port installation.

However, one problem with this method is the amount of time the ships are immobilized while the tubes are loaded or refilled and unloaded or emptied. The ships cannot be other than immobilized throughout the unloading process, which can take several days.

One particular document that may be referred to is EP 0 333 951, which discloses a tube-carrying ship for carrying out just such a method.

One problem that arises, and to which the present invention seeks to provide a solution, is therefore the provision of a method and installation for loading and unloading compressed natural gas that reduces ship immobilization time and therefore reduces the costs of shipping natural gas between the field and the port installation.

SUMMARY OF THE INVENTION

To this end, and in accordance with a first subject, the present invention provides a method for loading and unloading compressed natural gas onto and off ships, wherein the ships are capable of sailing on the surface of the sea and having receiving means, and wherein the compressed natural gas is storable in tubes installed on the receiving means. According to the invention, the method comprises the following steps. The tubes are placed in holders that are removable in order to allow the tubes to be loaded and unloaded onto and off the receiving means; a removable holder is supported on the receiving means above a defined level higher than the level of the surface of the sea. The receiving means are lowered beneath the defined level, while the removable holder is supported above the surface of the sea and above the defined level in such a way as to release the receiving means.

Thus, one feature of the invention is the installation of the tubes grouped together in holders, and the use of receiving means belonging to the ship and movable vertically for raising or lowering the removable holder standing thereon above the surface of the water in order to load or unload it. There is consequently no need to immobilize a ship during the phase of unloading the compressed gas because it is now possible to stand the removable holder in the port zone while the ship can be used for other tasks and in particular, as will be explained later, for shipping a removable holder from the port zone to the field.

In a first and particularly advantageous variant of the invention, said ships have ballast tanks, and said ballast tanks are filled in order to lower said receiving means, and emptied in order to raise said receiving means. Thus, with the commonly used system of ballast tanks it is easy to lower the receiving means by filling the tanks with seawater, making the ship significantly lower in the water. Since the receiving means are attached to the ship, they descend by the same amount as the ship.

In another and no less advantageous variant of the invention, said ships have lifting means for lifting said receiving means, and said lifting means are actuated to lower said receiving means and to raise said receiving means. As a result, it is possible to actuate the receiving means and cause them to move relative to the ship.

To unload a holder that is initially standing on said receiving means above said defined level, said receiving means are lowered until said holder is standing above the surface of the sea at said defined level and said receiving means are freed.

Conversely, advantageously, in order to load a removable holder onto a ship, said receiving means are lowered and positioned underneath said holder and said receiving means are raised again until said holder is supported on said receiving means and until said holder is lifted above said defined level. Next, once loaded, the ship can transport the holder wherever desired and in this particular case as explained below, to the field.

In accordance with another subject, the present invention provides an installation for loading and unloading compressed natural gas onto and off ships, wherein the ships are capable of sailing on the surface of the sea and have receiving means, and the compressed natural gas is storable in tubes installed on the receiving means. The installation comprises removable holders capable of housing the tubes in such a way as to enable the tubes to be loaded and unloaded onto and off the receiving means. Supporting means support a removable holder above the surface of the sea at a defined level. There are means for lowering the receiving means to below the holder and for raising the receiving means in such a way as to lift the holder above said defined level and in such a way as to support it on the receiving means.

Another feature of the invention is therefore the use of removable holders containing the tubes and of supporting means for holding a removable holder above the surface of the sea in such a way that the ship's receiving means can be inserted under the holder. In this way the receiving means can be moved up again into contact with the holder in such a way as to transfer the support points of the holder from the supporting means to the receiving means. The holder is thus now entirely supported by the receiving means, and the ship can move off with the holder.

In a first and particularly advantageous variant of the invention, said ships have ballast tanks for lowering said receiving means by filling said tanks and raising said receiving means by emptying said tanks. Thus, with suitable pumping means, the ballast tanks can be filled with seawater to cause the ship to ride significantly lower in the water, and then emptied in order to raise the ship and hence also the receiving means.

In a second variant of the invention, said ships have means for lifting said receiving means that are capable of being actuated to lower said receiving means and raise said receiving means. The receiving means are thus capable of being moved vertically relative to the ship, and in particular capable of being raised so as to support the holder which was initially supported on the supporting means.

The latter advantageously comprise a framework capable of resting on the sea bottom, which framework has columns that have a free receiving means such as to emerge at the surface of the sea. In order to support the holders above the surface of the sea, the supporting means are generally installed near the shoreline where the water is relatively shallow, and they possess free receiving ends which emerge from the water and on which complementary means fixed to the holders can be sat.

In one particularly advantageous mode of use of the invention, said framework comprises two rows of essentially parallel columns spaced out, capable of engaging with a removable holder. The two rows are thus spaced out in such a way that the ship can moor between the two, and as will be explained in more detail in the course of the description, the holder has a base that extends out from each side of the ship and is capable of engaging with the free receiving ends of the columns.

Other features and advantages of the invention will become clear from the following description of one particular embodiment of the invention, offered as a non-restrictive illustration, with reference to the appended drawings.

DESCRIPTION OF PREFERRED EMBODIMENTS

Figure 1:
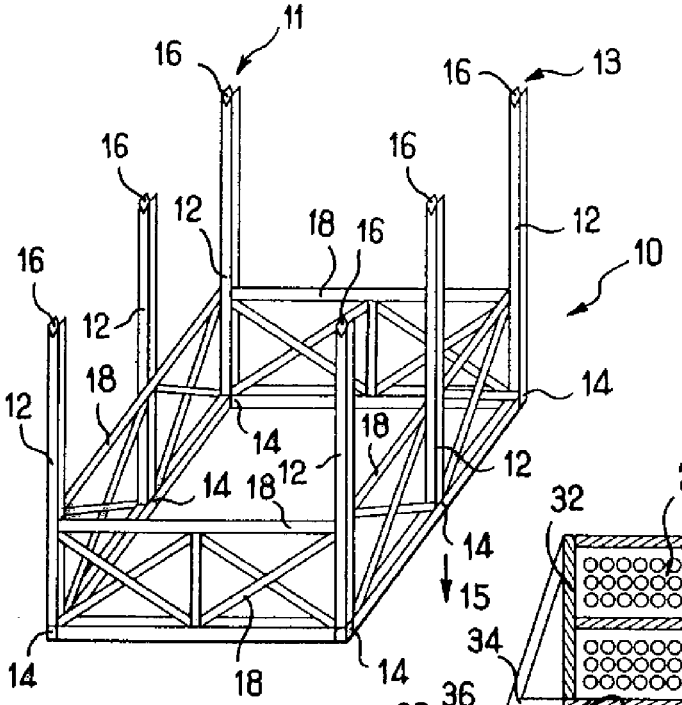
FIG. 1 is a partial perspective schematic view of one element of the invention.

FIG. 1 shows a framework 10 equipped with two parallel rows 11, 13 of three columns 12. The columns 12 each have a first or lower end 14 for resting on the seabed 15, and a free receiving end 16 for emerging above the sea surface. This free receiving end 16 also has a notch whose function will be described later.

Since this type of framework 10 is designed to be installed close to shorelines in the vicinity of a port, where the depth of the water is relatively shallow, of the order of ten meters or so, the columns 12 have a length substantially greater than this depth of water. The columns 12 are also relatively strong and they have little tendency to bend. Furthermore, they can be kept in fixed vertical relative positions by spacer bars 18 connecting their bottom ends close to the seabed.

Figure 2:
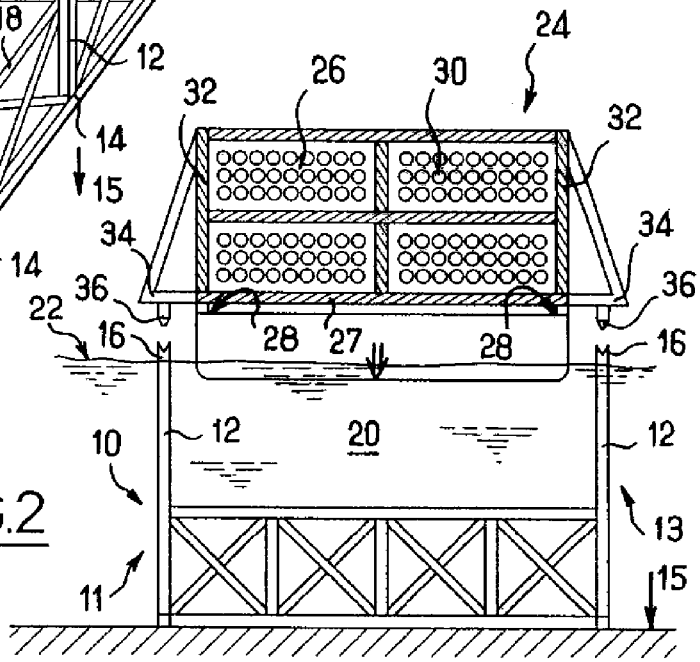
FIG. 2 is a schematic view in right vertical section of the element as illustrated in FIG. 1, over which another element is placed in the first phase of use.

Turning now to FIG. 2, this shows the same framework 10 in right vertical section looking at two columns 12 of the two parallel rows 11, 13. The framework 10 rests on the seabed 15 and the columns 12 are spaced out so that they leave a free space 20 at the top and emerge above the sea surface 22. Said free upper space 20 is of course large enough to take the ship. This figure also shows in right section a ship 24 floating on the surface of the sea between the two rows 11, 13 of columns 12, carrying a removable holder 26. The ship here has ballast tanks (not shown) by which the ship 24 can be partly and significantly submerged in the water by filling said ballast tanks and conversely floated higher in the water by emptying the tanks.

The removable holder 26 has a base 27 and the ship 24 has receiving means 28 capable of supporting the base 27. The tubes 30 are also laid in the removable holder 26 in such a way as to be able to store the compressed natural gas. The base 27 is continued vertically and laterally by columns 32 to keep the tubes 30 in, and is continued laterally by supporting means 34 projecting to either side of the ship 24 over the free receiving ends 16 of the columns 12 rising above the sea surface.

The supporting means 34 comprise locating pins 36 for engaging in the notches in the free receiving ends 16.

Figure 3:
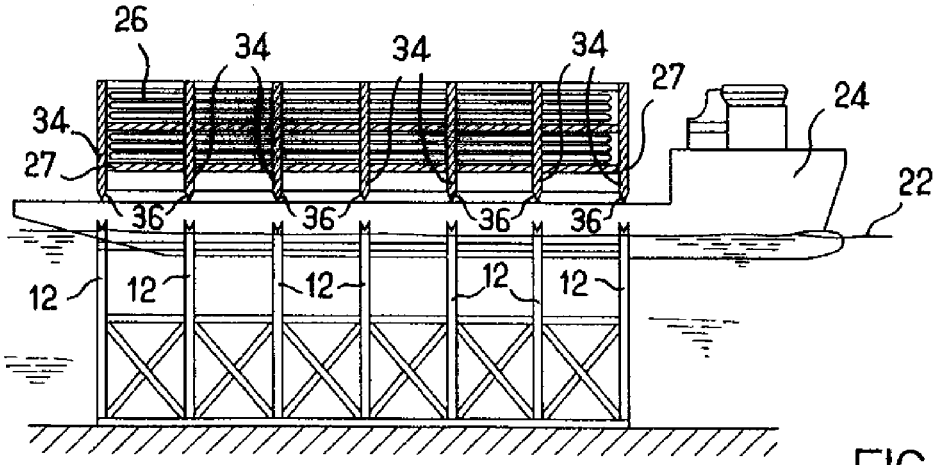
FIG. 3 is a schematic view in longitudinal vertical section of the assembly illustrated in FIG. 2.

FIG. 3 again shows the ship 24 on the sea surface 22, between the two rows of columns 12, supporting the removable holder 26 in a position such that each supporting means 34 of each of the lateral edges of the base 27 is situated in line with its own column 12 among the rows 11, 13 of columns 12.

In this first phase of use, the ship 24 is transporting for example a full holder 26 and is coming to offload it and then take away an empty holder. Its ballast tanks are therefore empty and it is high in the water.

From this position the ship 24 is guided so that the locating pins 36 are situated exactly over the notches in the free ends 16 of the columns 12. The ballast tanks are then gradually filled so that the ship 24 partially descends in the water, making the receiving means 28 lower.

Figure 4:
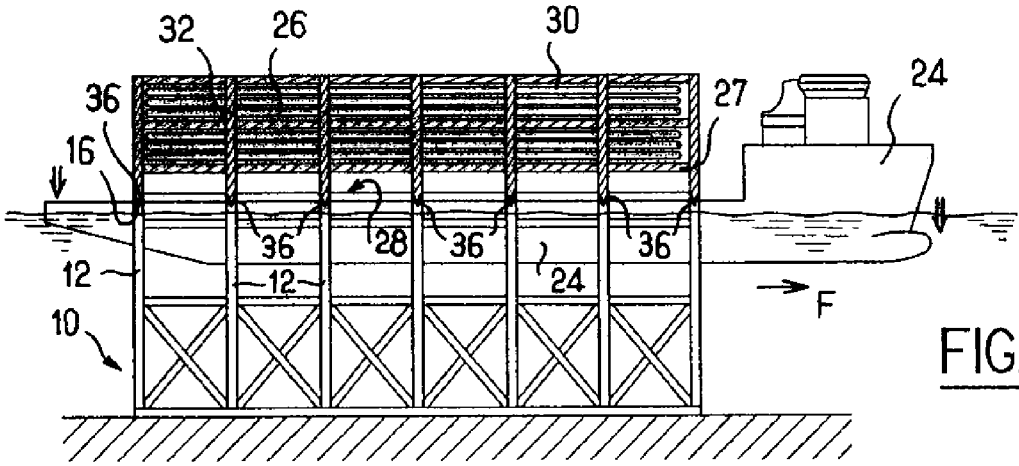
FIG. 4 is a schematic view in longitudinal vertical section of the assembly illustrated in FIG. 3, in the second phase of use.
Figure 5:
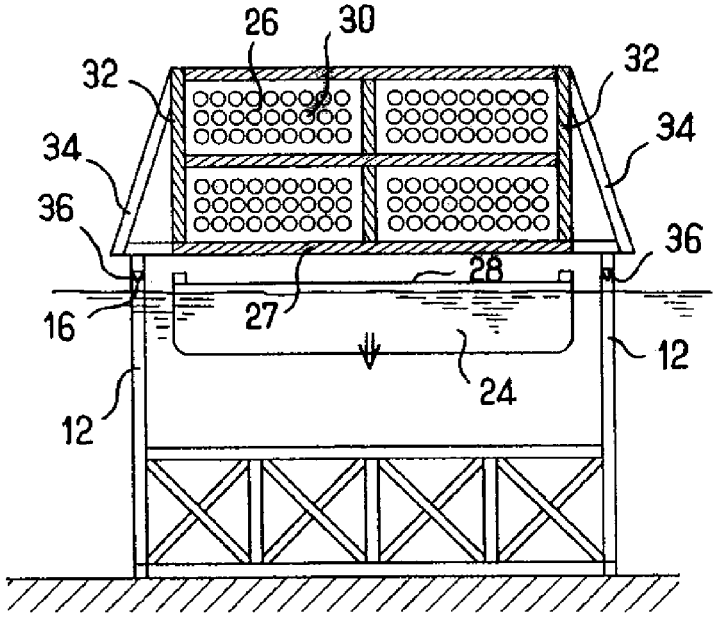
FIG. 5 is a schematic view in right vertical section of the assembly illustrated in FIG. 4.
Figure 6:
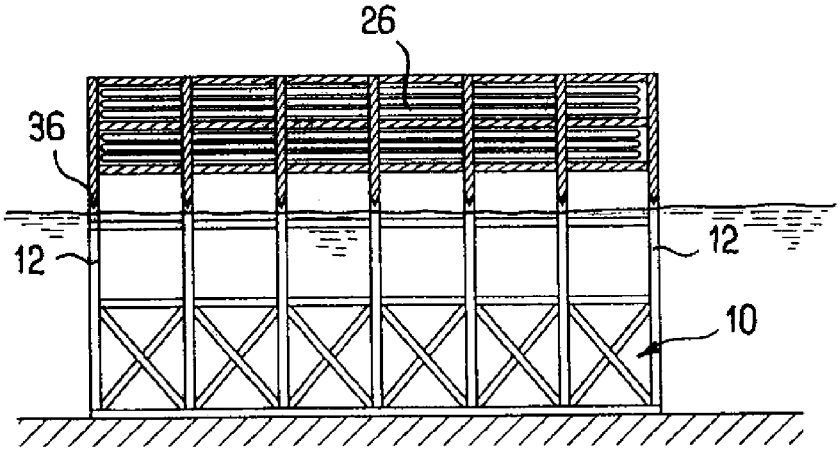
FIG. 6 is a schematic view in longitudinal vertical section of the elements of the invention in the third phase of use.

In this way, as illustrated in FIGS. 4 and 5, the locating pins 36 eventually engage in the recesses in the free ends 16, and when the ballast tanks are sufficiently filled the weight of the holder 26 is entirely transferred to the columns 12 of the framework 10, while the receiving means 28 are freed. From this position the ship 24, freed of its holder 26, is propelled translationally parallel to the rows 11, 13 in the direction of the arrow F illustrated in FIG. 4. The holder 26 is therefore entirely supported by the framework 10 through its columns 12, as FIG. 6 shows. Also, the ship 24 can then be engaged in another framework, this time supporting an empty removable holder, which it will pick up by emptying the ballast tanks filled during the previous phase.

The invention therefore relates to a method and installation for loading and unloading compressed natural gas onto and off ships, said ships being capable of sailing on the surface of the sea and having receiving means that are movable vertically relative to the surface of the sea, said compressed natural gas being storable in tubes mounted in holders, said holders being installed on said receiving means, said receiving means being capable of being lowered and positioned underneath a removable holder and capable of being raised to lift said holder so that it is supported on said receiving means; and the installation comprises supporting means for supporting said holder above the surface of the sea at a defined level, so that said receiving means can be positioned underneath said holder and said holder can be lifted above said defined level.

In another mode of use (not shown) of the invention, the ship comprises movable receiving means capable of being moved with vertical translational movement by lifting means. In one particular variant its lifting means comprise vertical movable racks connected to the receiving means, said racks being engaged in drive mechanisms connected to said ship.

In yet another mode of use, the invention relates to a loading and unloading method, said natural gas being loadable in a loading zone which may for example be above an undersea field, and unloadable in an unloading zone which may for example be a port installation. The invention provides first and second ships and first, second and third holders. The natural gas is loaded into said first removable holder which is supported on the receiving means of said first ship situated in said loading zone and the natural gas is simultaneously unloaded from the second removable holder which is supported above the surface of the sea in said unloading zone, while said third holder is being transferred with said second ship from one of said zones to the other.

At least one pair of supporting means consisting of first supporting means and second supporting means is also installed in the unloading zone.

Either the second ship leaves the unloading zone with an empty holder in order to go to the loading zone, and then, when the second ship arrives in the loading zone it takes the place of the first ship in order to fill the third holder, said first ship transfers the full first holder to the loading zone.

Or, the second ship leaves the loading zone with a full removable holder to go to the unloading zone, and then, when the second ship arrives in the unloading zone with its full third holder it rests it on the available supporting means before loading the second holder, which is empty and resting on the other supporting means, in order to transfer it to the loading zone.

By means of the invention, therefore, a holder of filled compressed gas tubes is first deposited in a port installation, and then another holder of empty tubes is collected in order to take them for filling in the environs of a field. In this way, by mobilizing two ships and three tube holders, the ships can be kept transferring compressed gas in uninterrupted rotation, thus limiting the costs associated with immobilization of the ships. What is more, such a method limits the risks associated with unloading in a port installation because the holders are supported above the surface of the water at a defined distance from sensitive port installations.

As a separate issue, the ballast tank filling and emptying means, or the racks and drive means, can be replaced with hydraulic jacks.

It is of course also possible to combine these means in order to optimize the unloading and loading of the holders. The boats are also equipped with a compression system for compressing the gas while loading it into the tubes, and each removable holder is usually equipped with a decompression system. It is also conceivable to use only one decompression system because only one tube holder is unloaded at a time.

The invention claimed is:

1. A method for loading and unloading compressed natural gas onto and off first and second ships, wherein the ships are capable of sailing on the surface of the sea, the ships have receivers, and the compressed natural gas is storable in tubes that are installed on the receivers;

the loading method comprising:

establishing a loading zone where natural gas is loadable;

placing the tubes in a first holder wherein the first holder is removable from the receivers in order to allow the tubes to be loaded and unloaded onto and off the receivers;

positioning the first holder at a first defined level above the surface of the sea;

lowering and positioning at least a first receiver of the first ship underneath the first holder and then raising the first receiver of the first ship until the first holder at the first defined level is supported on the first receiver of the first ship; and raising the first receiver of the first ship to lift the first holder above the first defined level;

the unloading method comprising:

establishing an unloading zone where natural gas is unloadable;

supporting a second holder removably on a receiver of a second ship such that the second holder is at a height above a second defined level higher than a level of the surface of the sea;

then lowering the receiver of the second ship, while supporting the removable second holder on the receiver of the second ship with the second holder above the second defined level and lowering the receiver of the second ship in such a way as to release the receiver of the second ship from the second holder, which receiver of the second ship had been supporting the second holder; and unloading natural gas from the second holder while supporting the second holder above the surface of the sea in the unloading zone, the loading and unloading method further comprising transferring a third holder along with the second ship from one of the loading and unloading zones to the other of the zones.

2. The loading and unloading method as recited in claim 1, wherein the ships have ballast tanks, and the lowering of the receiver comprises filling the ballast tanks of the respective ship having the receiver to lower the receiver, and raising the receiver comprises emptying the ballast tanks in order to raise the receiver.

3. The loading and unloading method as recited in claim 1, wherein the ships have lifting devices for lifting the receivers, the method further comprising activating the lifting device of the respective the ship selectively to lower the receiver and to raise the receiver.

4. The loading and unloading method as recited in claim 1, wherein the lowering of the receiver comprises lowering the receiver to beneath the defined level and then moving a part of the respective the ship underneath the holder and lifting the holder.

5. The loading and unloading method as recited in claim 1, further comprising loading natural gas into the first holder while supporting the first holder on the receivers of the first ship situated in the loading zone.

* * * * *